US007393032B2

(12) United States Patent
Hoff

(10) Patent No.: US 7,393,032 B2
(45) Date of Patent: Jul. 1, 2008

(54) ICE CHEST SCOOP APPARATUS

(76) Inventor: Carl T. Hoff, 1330 Elderwood Dr., Corona, CA (US) 92882

( * ) Notice: Subject to any disclaimer, the term of this patent is extended or adjusted under 35 U.S.C. 154(b) by 71 days.

(21) Appl. No.: 11/522,664

(22) Filed: Sep. 18, 2006

(65) Prior Publication Data

US 2008/0067822 A1 Mar. 20, 2008

(51) Int. Cl.
*B25J 1/04* (2006.01)

(52) U.S. Cl. ..... 294/19.1; 294/27.1; 294/55

(58) Field of Classification Search ..... 294/19.1, 294/19.2, 55, 27.1, 28, 30, 31.2; 209/417–419; 56/400.11, 400.12, 400.13, 400.14, 400.15
See application file for complete search history.

(56) References Cited

U.S. PATENT DOCUMENTS

| | | | | | |
|---|---|---|---|---|---|
| 291,395 | A | * | 1/1884 | Peggs | 209/419 |
| 1,095,585 | A | * | 5/1914 | Mack | 56/328.1 |
| 1,684,995 | A | * | 9/1928 | Kennard | 220/491 |
| 2,279,442 | A | * | 4/1942 | Burns et al. | 248/311.2 |
| D206,076 | S | * | 10/1966 | Lehman | D21/721 |
| 4,190,279 | A | * | 2/1980 | Sguazzin | 294/49 |
| 4,198,720 | A | | 4/1980 | Matsumoto | |
| 4,828,690 | A | | 5/1989 | Montez | |
| 5,110,168 | A | * | 5/1992 | Petrillo | 294/19.2 |
| 5,199,349 | A | | 4/1993 | Hansen | |
| 5,246,260 | A | | 9/1993 | Racicot | |
| 5,360,247 | A | | 11/1994 | Vachter | |
| 5,370,434 | A | | 12/1994 | Kellett | |
| D362,038 | S | * | 9/1995 | Schatz | D21/721 |
| 5,511,841 | A | * | 4/1996 | Allen | 294/66.1 |
| 5,573,292 | A | | 11/1996 | Citino | |
| 6,598,334 | B1 | | 7/2003 | Edevold | |

FOREIGN PATENT DOCUMENTS

| | | | |
|---|---|---|---|
| GB | 2125661 | * | 3/1984 |

* cited by examiner

*Primary Examiner*—Dean J Kramer
(74) *Attorney, Agent, or Firm*—Gene Scott; Patent Law & Venture Group

(57) ABSTRACT

A scoop is constructed for retrieving a beverage container from an ice chest. The scoop provides a rectangular basket with arcuate cross rib extending between and joining a rim. The basket is sized, shaped, and positioned so as to provide low resistance when drawn through an ice and water mixture within the ice chest and the rim has openings for receiving the necks of bottles such as soft drink or beer bottles.

6 Claims, 2 Drawing Sheets

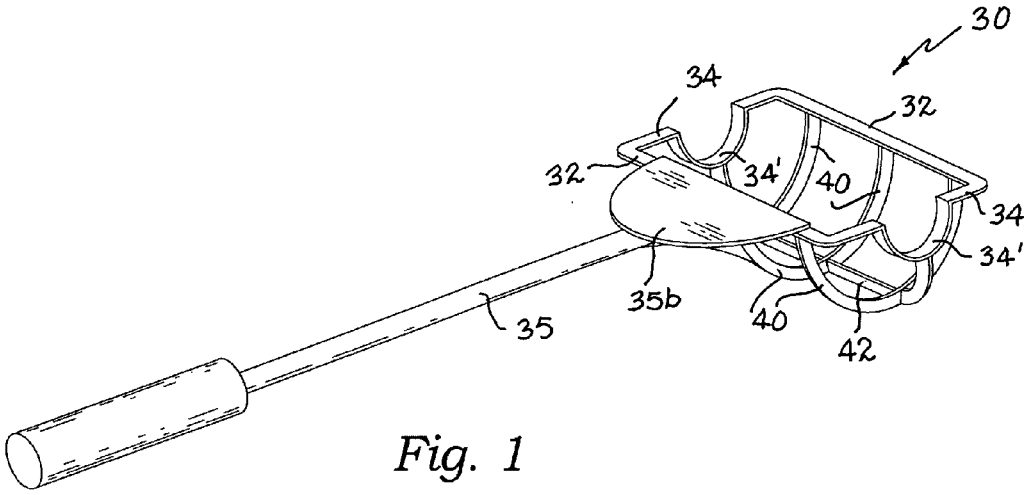
Fig. 1
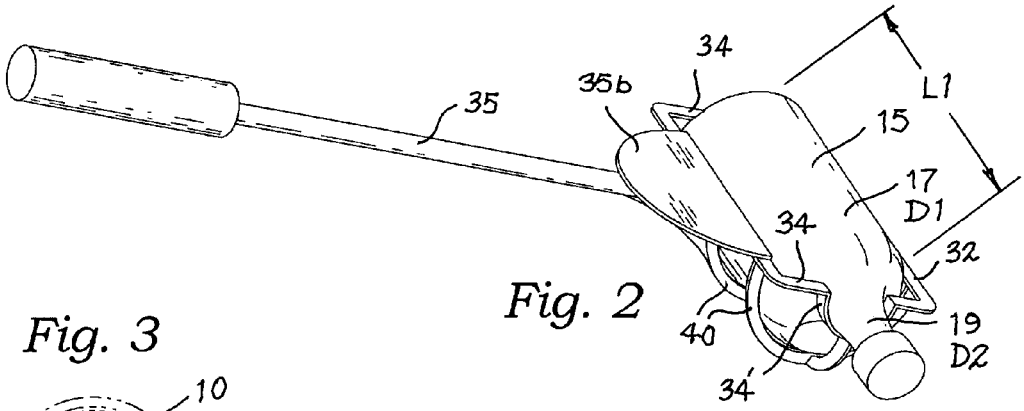
Fig. 2
Fig. 3
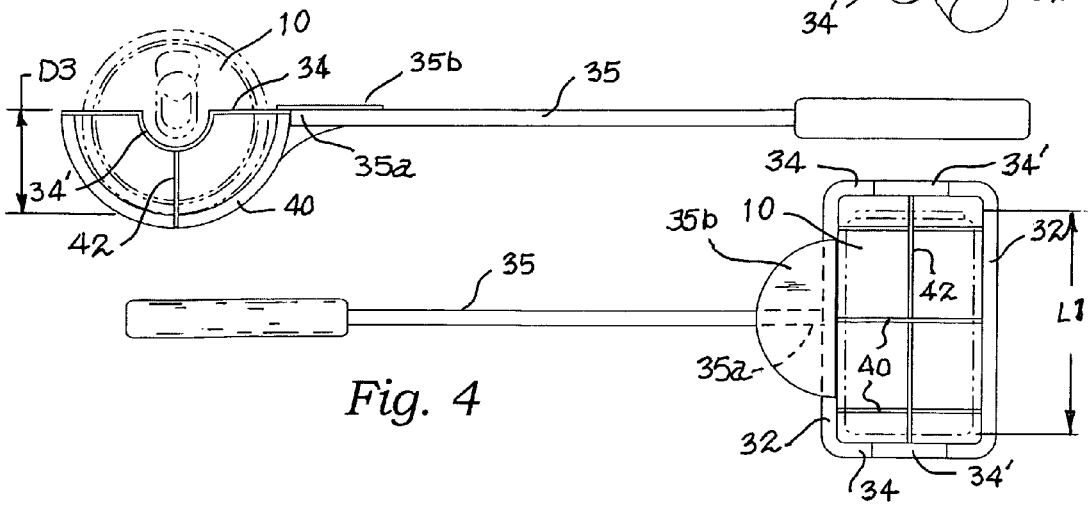
Fig. 4

ICE CHEST SCOOP APPARATUS

CROSS-RELATED TO RELATED APPLICATION

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

REFERENCE TO A "MICROFICHE APPENDIX"

Not applicable.

BACKGROUND OF THE INVENTION

1. Field of the Present Disclosure

This disclosure relates generally to scoops and devices for picking up objects and more particularly to such a scoop for obtaining a beverage from an ice chest.

2. Description of Related Art including information disclosed under 37 CFR 1.97 and 1.98

Racicot, U.S. Pat. No. 5,246,260, discloses a rake-like device for retrieving golf balls that includes an elongated handle and a ball retriever that is made from a plurality of "U"-shaped tine members disposed in transversely spaced apart relation to one another. The open end of each tine faces the user of the device during the retrieving operation. A triangular structure is formed on the bottom part of each tine and serves to trap a retrieved golf ball. The handle is pivotally mounted to the retriever so that the device can be stored in a narrow space when not in use.

Citino, U.S. Pat. No. 5,573,292, discloses a dual-purpose spatula-skimmer kitchen utensil that provides a rigid, planar surface having a thin leading edge for being pushed beneath a food product (e.g., cooking within a shallow frying pan or the like). A depression or concavity in the planar surface has perforations or holes there through which permit liquid to flow but trap small food particles. In a further embodiment, the depression is ramped and has substantially flat upper and lower surfaces. The utensil may be used for skimming and/or straining cooking liquids (e.g., to filter food particles suspended in oil used in frying), and also for flipping or turning food products.

Kellett, U.S. Pat. No. 5,370,434, discloses a retrieval device for retrieving floating objects from the surface of a body of water. The device comprises an extensible boom formed by a semi-rigid, non-resilient, buoyant cable and a grab device attached to one end of the cable. The cable is adapted to be stowed within a portable housing when not in use, and to be extended therefrom for use. The housing is a hollow, doughnut-shaped housing providing a toroidally-shaped interior passage adapted to accommodate the cable and to coil it as it is inserted into the passage.

Vachter, U.S. Pat. No. 5,360,247, discloses a cylindrical receptacle that has an open front end and a closed rear end. A handle leads rigidly from a side wall of the receptacle in a lateral direction at approximately 45.degree. from the longitudinal plane of the receptacle. In one embodiment the receptacle has longitudinal side openings of a length greater than one-half the length of the receptacle and of a dimension to hold scooped articles but to allow foreign material to fall or be shaken out. Another embodiment of the invention has a front fluted edge. In yet another embodiment, the receptacle has a closed side wall and the connection between the handle and the receptacle provides communication between the handle and the receptacle. In this embodiment the handle has a fitting at its free end for a garden hose whereby the receptacle can be cleaned by pressured water flowing through the handle. The connection for the handle projects a short distance into the receptacle and includes a spray head for efficiently directing the pressured water interiorly of the receptacle.

Montez, U.S. Pat. No. 4,828,690, discloses a hand tool having a tapered wedge head, an entrapment mesh supported by a carriage structure and cantilevered from the wedge head, and a handle adjustably coupled to the carriage structure. The tapered wedge head ramps materials, such as sand and soil, into the entrapment mesh. The entrapment mesh is fixed to the carriage structure such that the face and opposed sides of the carriage structure are open. The entrapment mesh is cantilevered from the wedge head to prevent contact of the mesh with the ground.

Matsumoto, U.S. Pat. No. 4,198,720, discloses a dirt remover for a water tank, which can readily remove not only the dirt floating on the water surface and the dirt suspended in the water but also the dirt settling to the tank bottom without inflicting any injury on the bottom surface of the tank, that includes a frame formed of a rear frame member, two lateral frame members extending forward from the opposite ends of the rear frame member, and a frontal frame member set in position straight between the leading ends of the two lateral frame members. A net is hung from the inner sides of the frame loosely enough for the middle portion thereof to sag down, the net forming a scooping portion in conjunction with the frame. A handle has a leading end thereof attached to the rear frame member of the frame, the handle serving for the operation of the scooping portion. A plate-shaped sliding piece made of a material possessing proper degrees of rigidity and elasticity is fastened to the frontal frame member of the frame throughout the entire length thereof in such a way that the leading end of the sliding piece will protrude from the scooping portion.

Edevold. U.S. Pat. No. 6,598,334, discloses an asymmetrical conical strainer-scoop adapted for clearing ice chips, ice chunks, and other debris from a hole cut through ice covering a body of water. The asymmetrical conical strainer-scoop includes a perforated asymmetrical conical device of a unique design, comprised of a flexible and durable material such as UHMW polyethylene in sheet form, which is perforated with a plurality of straining apertures, and which is attached to one end of a handle, by means of conventional fasteners. The handle, has a hole bored to provide means for attachment of a wrist-hanger strap.

Hansen, U.S. Pat. No. 5,199,349, discloses a skimmer/separator ladle that comprises a handle of an elongated configuration and a bowl of a cup-shaped configuration defining an upper rim. The handle and the bowl are connected together and the handle extends upwardly from the bowl at the upper rim of the bowl. In order to render it possible to carry out any skimming/separation operation, the bowl has an outwardly protruding tongue arranged at a first rim section of the bowl, which tongue is located below the upper rim of the bowl, and further one or more through-going holes which are provided in the bowl and arranged at a second rim section of the bowl, which one or more through-going holes are located below the upper rim of the bowl and further located above the tongue.

The related art described above discloses several scoops for retrieving different objects. However, the prior art fails to disclose a scoop that is particularly suitable for picking cold beverages from an ice chest. The present disclosure distinguishes over the prior art providing heretofore unknown advantages as described in the following summary.

BRIEF SUMMARY OF THE INVENTION

This disclosure teaches certain benefits in construction and use which give rise to the objectives described below.

Ice chests are used at gatherings and parties for chilling beverage containers such as soft drink cans and beer bottles. The beverage containers are buried within an ice and water mixture so that they are difficult to retrieve without getting one's hands wet and uncomfortably chilled. The present apparatus is a scoop particularly designed for retrieving such beverage containers from an ice chest without getting ones hands wet and cold. The apparatus is particularly configured to pick up one beverage container at a time by sweeping the scoop through the ice chest and without also picking up ice cubes. This is accomplished by configuring the scoop so as to fit a beverage container closely and yet provide open spaces between its ribs to allow ice cubes to pass through. Therefore, the beverage container has a tubular body terminating at one end with a smaller diameter tubular neck. A basket provides lateral legs and longitudinal legs joined to form a basket rim. Arcuate cross rib extend between and join the lateral legs of the rim, and at least one reinforcing rib extends between and joins the longitudinal legs. The legs and ribs are sized, shaped, and positioned so as to provide low resistance when the basket is drawn through a water-ice mixture of an ice chest. The basket is sized for accepting the beverage container without also scooping up ice cubes and has a feature for accepting the necks of bottles.

A primary objective inherent in the above described apparatus and method of use is to provide advantages not taught by the prior art.

Another objective is to provide a means for retrieving a cold beverage from an ice chest without placing ones hands into the ice chest.

A further objective is provide such a device that is able to capture a beverage container without picking up ice cubes as well.

A still further objective is to provide such a device adapted for receiving the necks of bottles.

A yet further objective is to provide such a device adapted particularly to receive a beverage container securely so as to not easily allow the ejection of the received container.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Illustrated in the accompanying drawing(s) is at least one of the best mode embodiments of the present invention In such drawing(s):

FIG. 1 is a perspective view of the presently described apparatus;

FIG. 2 is a further perspective view thereof showing a beverage container mounted therein;

FIG. 3 is a side view thereof;

FIG. 4 is a top view thereof;

DETAILED DESCRIPTION OF THE INVENTION

Figure 5:
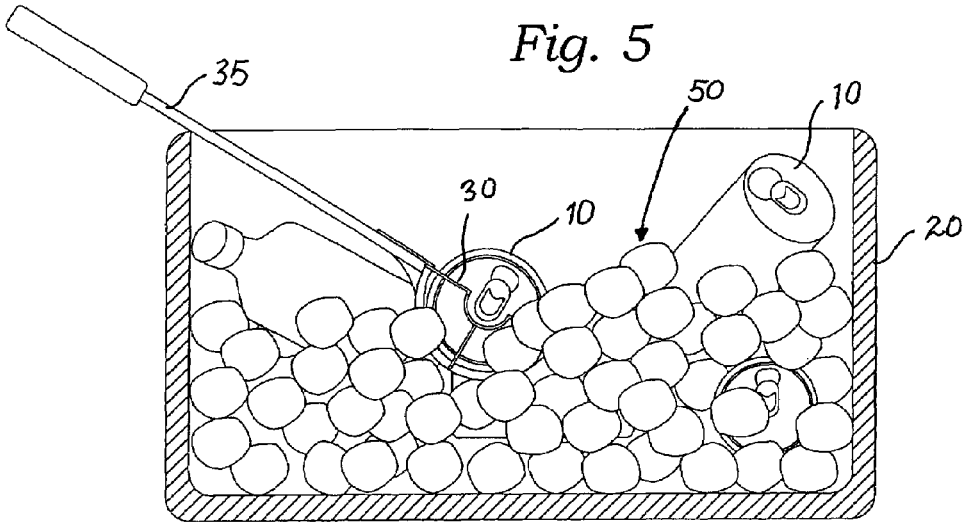
FIG. 5 is a side elevational sectional view of an ice chest showing the means for using the apparatus.

The above described drawing figures illustrate the described apparatus and its method of use in at least one of its preferred, best mode embodiment, which is further defined in detail in the following description. Those having ordinary skill in the art may be able to make alterations and modifications to what is described herein without departing from its spirit and scope. Therefore, it must be understood that what is illustrated is set forth only for the purposes of example and that it should not be taken as a limitation in the scope of the present apparatus and method of use.

Described now in detail is an apparatus for retrieving a beverage container, such as a soft drink can 10 or a beer bottle 15, from an ice chest 20 without placing ones hands into the chest 20. Typically, the beer bottle 15 has a tubular body 17 of a first selected diameter D1, terminating at one end of the beer bottle 15, with an axial tubular neck 19 of a second selected diameter D2, where the first selected diameter D1 is greater than the second selected diameter D2 as is common practice for almost all beverage dispensing containers. The present apparatus uses this fact to advantage as will be described below.

The apparatus, as shown in perspective in FIG. 1, is a basket 30 providing a pair of spaced apart lateral legs 32 and a pair of spaced apart longitudinal legs 34 joined with the lateral legs 32 to form a rectangular closed circuit as is best shown in FIG. 4. Preferably, the basket 30 is mounted on an elongate handle 35 of the type shown in the figures, but which may be longer or shorter as desired and may be of a different conformation or style as would be desired by those of skill in the art. With respect to the construction of the basket 30, preferably, several arcuate shaped cross ribs 40 extend between and join the lateral legs 32, and at least one reinforcing rib 42 extends between and joins the longitudinal legs 34. Please see FIG. 4. The ribs 40, 42 provide rigidity to the structure of the legs 32, 34 and provide further advantages as will be described presently. Preferably, the legs 32, 34 and ribs 40, 42 are sized, shaped, and positioned to establish a desired shape of the basket 30 as well as to provide low resistance when the basket 30 is drawn through a fluid 50 such as the water and ice cubes in the ice chest 20 shown in FIG. 5, and furthermore, importantly, enable the ice cubes to pass through the basket 30 as it sweeps through the water and ice cubes. Furthermore, the ribs 40, 42 are positioned so that the beverage container is not able to pass, but is captured within the basket 30. The longitudinal legs 34 each provides a curved portion 34' of such size and position that with a beer bottle 15 positioned in a lateral orientation within the basket 30, and with the tubular body 17 abutting the cross ribs 40, i.e., the bottle 15 is fully engaged within the basket 30, one, or the other, of the curved portions 34' of the basket 30 abuts the tubular neck 19 of the bottle 15.

With respect to the handle 35, as shown in FIG. 4, a terminal end 35*a* of the handle 35 is joined to the basket 30 medially at one of the lateral legs 32, and this joining may be by metal or plastic welding or other permanent method. Alternately, the handle 35 may be molded integrally with the basket 30. A gusset plate 35*b* is preferably joined to both the handle 35 and the joined lateral leg 32 to provide rigidity and strength to the apparatus as significant force is required to move the apparatus through an ice chest full of beverage containers and ice cubes as shown in FIG. 5.

Figure 6:
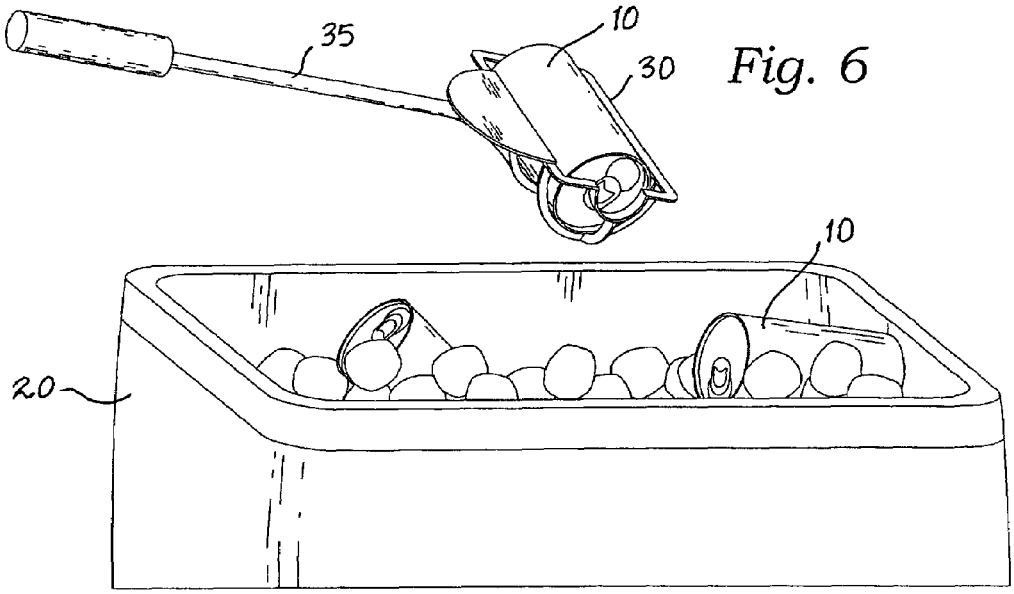
FIG. 6 is a perspective view showing the result of use of the apparatus.

To function effectively, the basket 30 has a depth D3 that is approximately equal to one-half of the first selected diameter D1 so that a beverage container nestles within the basket 30 in a manner where, once set as shown in FIG. 2, 3 or 6, it is unlikely for the container to be ejected as long as the basket moves through the ice chest 20 from left to right in FIG. 6, i.e., with the receiving open part of the basket 30 facing in the direction of motion of the apparatus.

Preferably, the longitudinal legs 34 are spaced apart by between approximately 5 and 5.5 inches and the lateral legs 32 are spaced apart by between approximately 2.63 and 3.0 inches, which is critical to the capture and subsequent non-rejection of a typical soft drink can as shown. In general, the spacing between the lateral legs 32 is between 1.05* D1 and 1.15*D1. The spacing between the longitudinal legs 34 is between 1.05*L1 and 1.15*L1, where L1 is the length of the beverage container not including the neck portion 19 if one is present. These are the prescribed spacing ranges. It has been discovered that spacing smaller than that prescribed prevents the effective capture of the beverage container, by the apparatus because a near miss typically results in pushing the container away rather then urging it into the basket, and a spacing larger than that prescribed frequently results in a captured beverage container being immediately ejected from the basket by other objects coming into contact therewith after the container has engaged the basket 30.

Preferably, the legs 32, 34 and the ribs 40, 42 are all positioned and joined so that they present the least resistance to the flow of ice cubes through the basket 30.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

SEQUENCE LISTING

Not applicable.

What is claimed is:

1. An apparatus for retrieving a beverage container from an ice chest, wherein the beverage container has a tubular body of a first selected diameter terminating at one end thereof with a coaxial tubular neck of a second selected diameter, the first selected diameter being greater than the second selected diameter, the apparatus comprising:

a basket providing:

a) a pair of spaced apart lateral legs;

b) a pair of spaced apart longitudinal legs joined with the lateral legs;

c) at least one arcuate cross rib extending between and joining the lateral legs;

d) at least one reinforcing rib extending between and joining the longitudinal legs;

the legs and ribs sized, shaped, and positioned so as to provide low resistance when the basket is drawn through a fluid and for enabling ice cubes to pass through the basket;

the longitudinal legs each providing a curved portion of such size and position that with the beverage container positioned in a lateral orientation within the basket and with the tubular body of the beverage container abutting the cross ribs, the curved portion of one of the longitudinal legs abuts the tubular neck of the beverage container.

2. The apparatus of claim 1 further comprising an elongate handle engaging the basket.

3. The apparatus of claim 2 wherein the handle is joined to the basket medially at one of the lateral legs.

4. The apparatus of claim 1 wherein the basket has a depth approximately equal to one-half of the first selected diameter.

5. The apparatus of claim 1 wherein the longitudinal legs are spaced apart by between 1.05 *times L1 and 1.15 *times L1, where L1 is the length of the beverage container not including the tubular neck.

6. The apparatus of claim 1 wherein the lateral legs are spaced apart by between 1.05 *times D1 and 1.15 *times D1, where D1 is the diameter of the tubular body of the beverage container.

* * * * *